US007056360B2

(12) United States Patent
Zeck

(10) Patent No.: US 7,056,360 B2
(45) Date of Patent: Jun. 6, 2006

(54) OPTICAL ODORIZATION SYSTEM

(76) Inventor: Mark Zeck, 2518 Stanolind Ave., Midland, TX (US) 79705-8426

( * ) Notice: Subject to any disclaimer, the term of this patent is extended or adjusted under 35 U.S.C. 154(b) by 554 days.

(21) Appl. No.: 10/287,392

(22) Filed: Nov. 4, 2002

(65) Prior Publication Data

US 2004/0083652 A1 May 6, 2004

(51) Int. Cl.
*C10J 1/28* (2006.01)

(52) U.S. Cl. ..... 48/195; 48/127.3; 48/190; 48/192; 48/193; 48/194; 137/2; 137/487.5

(58) Field of Classification Search ..... 48/127.3, 48/190, 192–195; 137/487.5
See application file for complete search history.

(56) References Cited

U.S. PATENT DOCUMENTS

| | | | | | |
|---|---|---|---|---|---|
| 2,098,626 | A | * | 11/1937 | Hough | 48/195 |
| 2,921,844 | A | * | 1/1960 | Hutchison | 48/195 |
| 3,193,147 | A | * | 7/1965 | Popp | 222/83.5 |
| 3,830,402 | A | | 8/1974 | Pardee | 222/57 |
| 3,907,515 | A | | 9/1975 | Mulliner | 44/2 |
| 4,025,315 | A | | 5/1977 | Mazelli | 44/52 |
| 4,137,940 | A | * | 2/1979 | Faisandier | 137/486 |
| 4,314,484 | A | * | 2/1982 | Bowman | 73/861.41 |
| 4,354,516 | A | | 10/1982 | Newell | 137/98 |
| 4,504,281 | A | | 3/1985 | Williams, Jr. et al. | 48/195 |
| 4,611,294 | A | * | 9/1986 | Stanfill | 700/68 |
| 4,936,828 | A | * | 6/1990 | Chiang | 604/65 |
| 5,304,327 | A | | 4/1994 | Welker et al. | 261/66 |
| 5,406,970 | A | | 4/1995 | Marshall et al. | 137/101.25 |
| 5,490,766 | A | | 2/1996 | Zeck | 417/63 |
| 6,142,162 | A | | 11/2000 | Arnold | 137/3 |
| 6,208,913 | B1 | | 3/2001 | Marshall et al. | 700/266 |
| 2001/0047621 | A1 | * | 12/2001 | Arnold | 48/195 |
| 2005/0112020 | A1 | * | 5/2005 | Zeck | 422/4 |

* cited by examiner

*Primary Examiner*—Glenn Caldarola
*Assistant Examiner*—Vinit H. Patel
(74) *Attorney, Agent, or Firm*—Charles D. Gunter, Jr.

(57) ABSTRACT

A system is shown for injecting a chemical, such as an odorant, from a chemical supply into a fluid containing system such as a natural gas pipeline. A tank of odorant is maintained under a positive pressure which exceeds that of the pipeline. An injection conduit communicates the odorant tank with the pipeline. A precise control flow valve, located within the injection conduit, meters odorant to be injected into the pipeline. The odorant is metered on a dropwise basis with individual drops of chemical being counted as they pass through the flow valve into the injection conduit and into the natural gas pipeline.

5 Claims, 3 Drawing Sheets

OPTICAL ODORIZATION SYSTEM

BACKGROUND OF THE INVENTION

1. Field of the Invention

The present invention relates generally to systems for injecting chemicals into gas pipelines and, more specifically, to an improved system and method for adding odorant to natural gas flowing in a pipeline.

2. Description of the Prior Art

There are many instances in which it is desirable to inject chemical of various types into natural gas pipelines. In addition to such substances as corrosion inhibitors and alcohol to inhibit freezing, odorants are commonly injected into natural gas pipelines. Natural gas is odorless. Odorant is injected into natural gas in order to provide a warning smell for consumers. Commonly used odorants include tertiary butyl mercaptan (TBM). Such odorants are typically injected in relatively small volumes normally ranging from about 0.5 to 1.0 lbs/mmscf.

The odorants are typically provided in liquid form and are typically added to the gas at a location where distribution gas is taken from a main gas pipeline and provided to a distribution pipeline. In such circumstances, the gas pressure may be stepped down through a regulator from, for example, 600 psi or more, to a lower pressure in the range of 100 psi or less. The odorants can also be added to the main transmission pipeline in some situations.

As will be apparent from the above discussion, the odorants which are added to natural gas are extremely concentrated. Odorants such as TBM and other blends are mildly corrosive and are also very noxious. If the job of injecting odorant is not performed accurately, lives are sometimes endangered. It would be possible for a homeowner to have a gas leak with a leak not being realized until an explosion had resulted if the proper amount of odorant was not present. Also, if a leak of odorant occurs at an injection site, people in the surrounding area will assume that a gas leak has occurred with areas being evacuated and commerce being interrupted. Contrarily, if such mistakes become common, people in the surrounding area will become desensitized to the smell of a potential gas leak and will fail to report legitimate leaks.

Two techniques are commonly used for providing odorization to natural gas in a main distribution pipeline. The first technique involves the injection of liquid odorant directly into the pipeline. A high pressure injection pump pumps the odorant from a liquid storage tank into a small pipe which empties directly into the main gas pipeline. Because odorant is extremely volatile, drops injected to the pipeline immediately disperse and spread throughout the gas in the pipeline. In this way, within a few seconds, the drops of liquid odorant are dispersed in gaseous form. U.S. Pat. No. 6,208,913, issued Mar. 27, 2001, to Marshall and Zeck, and U.S. Pat. No. 5,490,766, issued Feb. 13, 1996, to Zeck, both show state of the art fluid pumps for injecting odorant.

In the prior art systems, the flow of gas in the pipeline is typically metered so that liquid odorant can be injected periodically. For example, a few drops of odorant will suffice for a 1000 SCF flow of natural gas. When the gas flow meter indicates that 1000 SCF of natural gas have flowed through the pipe, the corresponding previously determined amount of liquid odorant is injected into the pipeline. As another 1000 SCF of gas flows past the injection site, another injection of odorant is performed. Even though the injection is performed on a periodic basis, the odorant diffusion within the gas provides for adequate levels of odorant throughout the pipeline, assuming the time between injections is not too great.

There are several disadvantages with this prior art technique. As mentioned above, the odorant liquid is extremely noxious. The injection pump must therefor be designed so that no odorant can leak. This requires a pump design which is relatively expensive and complex in order to meet the required operating conditions. In even such sophisticated systems, there is an unpleasant odor present when working on the pump which can make people think that there is a natural gas leak.

Another technique for odorizing a natural gas pipeline involves bypassing a small amount of natural gas at a slightly higher pressure than the pressure of the main distribution pipeline, through a tank containing liquid odorant. This bypass gas absorbs relatively high concentrations of odorant while it is in the tank. This heavily odorized bypass gas is then placed back into the main pipeline. The odorant, now volatalized, is placed back into the main pipeline and diffuses throughout the pipeline in much the same manner as described with respect to the liquid injection system. U.S. Pat. No. 6,142,162, issued Nov. 7, 2000, to Arnold, shows such a method for odorizing natural gas in a pipeline utilizing bypass piping in conjunction with a liquid odorant storage tank.

One disadvantage of the bypass system is the fact that the bypass gas picks up large and inconsistent amounts of odorant from the liquid in the tank and becomes completely saturated with odorant gas. As a result it is necessary to carefully monitor the small amounts of bypass gas which are used. Also, natural gas streams typically have contaminates such as compressor oils or condensates which can fall out into the odorant vessel in bypass systems. These contaminates create a layer that reduces the contact area between the liquid and the bypass stream. This necessarily degrades the absorption rate of the stream.

The present invention has as its object to provide a method and system for odorizing natural gas which is simpler in design and more economical in operation than the prior art systems and which can be used in both small and large low applications.

SUMMARY OF THE INVENTION

A system is shown for injecting a chemical, such as an odorant, from a chemical supply into a fluid containing system at a desired injection rate. The fluid containing system can be, for example, a natural gas pipeline. The system includes a chemical storage tank containing a chemical to be injected. The chemical storage tank communicates with the natural gas pipeline by means of an injection conduit. A pressurized gas source communicates with the chemical storage tank for maintaining the tank at a desired positive pressure above the pressure of the natural gas pipeline. Metering means, located within the injection conduit, meter chemical to be injected into the natural gas pipeline. The chemical is metered on a dropwise basis with individual drops of chemical being counted as they pass through the metering means into the injection conduit and into the natural gas pipeline.

In the preferred embodiment of the invention, a system is provided for odorizing natural gas flow through a pipeline by injecting odorant into the pipeline at a controlled rate. The system includes an odorant storage tank containing an odorant to be injected. A pressurized source of inert gas, such as nitrogen, communicates with the odorant storage tank for maintaining the tank at a desired positive pressure above the pressure of the natural gas pipeline. An injection conduit communicates the odorant storage tank with the pipeline. A photooptic metering means, located within the injection conduit, meters odorant to be injected into the pipeline. The odorant is metered on the drop wise basis with individual drops of odorant being counted as they pass through the metering means into the injection conduit and into the pipeline. A controller, operative under the control of a program stored therein can be included in the system for controlling, monitoring and verifying the amount of odorant ultimately injected into the natural gas pipeline.

DETAILED DESCRIPTION OF THE INVENTION

Figure 1:
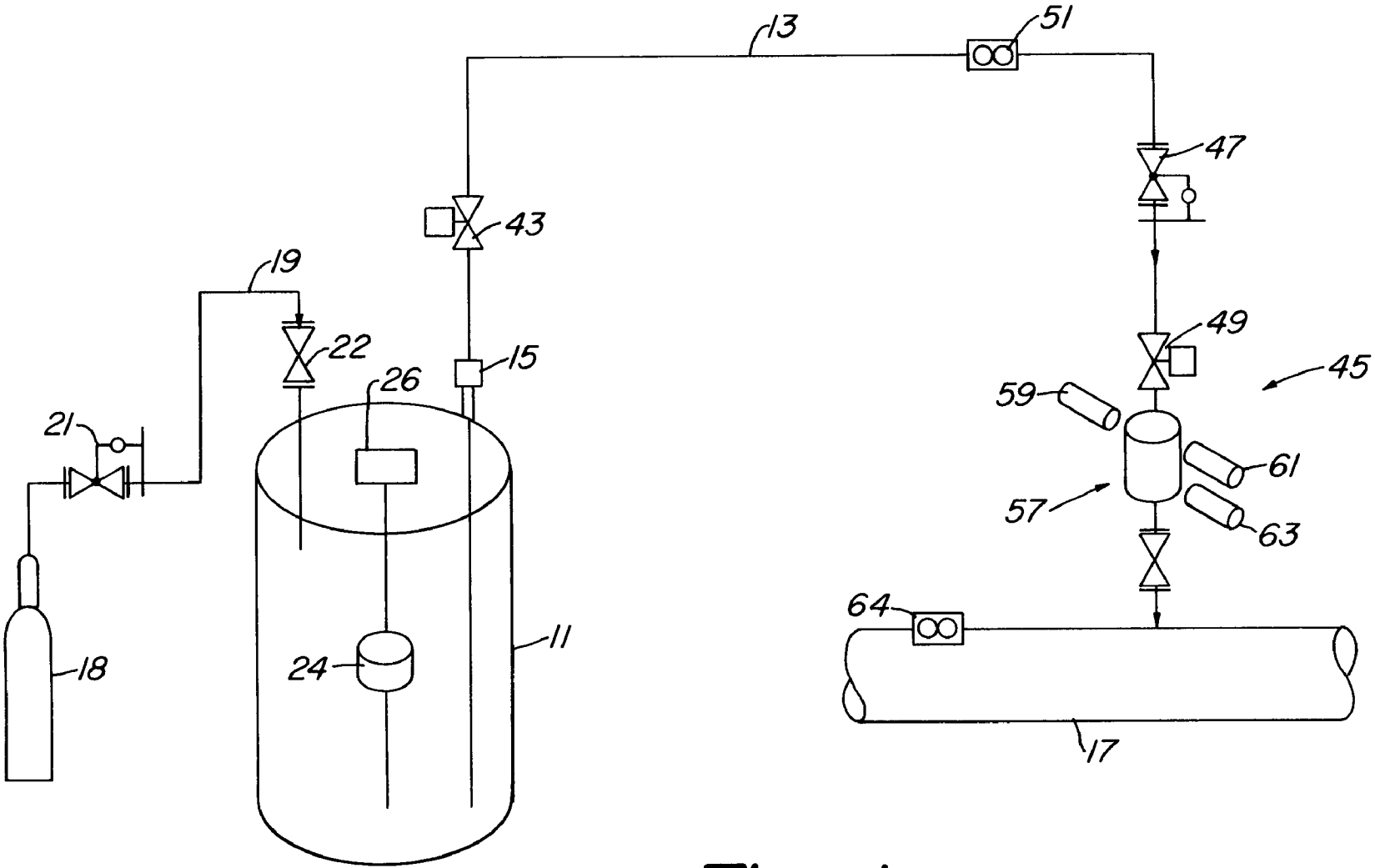
FIG. 1 is a schematic representation of the odorization system of the invention.

The present invention offers several unique advantages over existing chemical injection and odorization systems in both small and larger flow rate applications. It has particular applicability to odorization systems for natural gas pipelines but those skilled in the art will understand that the system can also be used to inject other chemical substances, such as alcohol to inhibit freezing, corrosion inhibitors, and the like. In the case of low flow rates, such as those typically found in city distribution systems, such systems have typically been difficult to odorize accurately for the following reasons. A low pressure environment does not provide a positive seating action for positive displacement (fluid pump) type odorization systems. Such systems require a pump inlet pressure that is precariously close to the natural gas pipeline pressure, thereby inviting free flow or volume surges in the system. In the low flow rate situation, the amount of odorant per stroke is extremely small. The current systems tend to vapor lock or have such a long time between injections that gas is not evenly odorized. These low flow rate systems also need to be located where the distribution system is located. Thus, they are commonly surrounded by hospitals, schools, metro areas and other residential areas. The currently available injection systems are complex and do not contain fugitive emissions during maintenance. During operation, many of these systems exhaust natural gas into the air with every stroke of the injection pump.

There are also known disadvantages associated with the high flow rate applications. These high flow rate applications are typically found on interstate gas pipelines, for example. One disadvantage is the turn down ratio associated with such systems. On theses systems gas flow rate can range considerably. When a positive displacement pump is sized for lower end capacity, it is required to work too hard at the upper end. This causes wear on the equipment prematurely. Sometimes the upper end demand cannot be met and desired odorization levels cannot be met. As a result, hybrid dual pump configurations have been tried in the past, resulting in expensive and complex system designs. When the pump is sized for the higher end of demand, the time between strokes is excessive. This results in dead spots. As a result, the gas is not evenly odorized.

Another disadvantage of the high flow applications is the fact that the larger pumps suffer a greater failure rate with subsequent leakage, due to increased surface area of the diaphragms and seals. Considerable actuation gas (normally natural gas) is required to actuate the pump. These systems also suffer from winter freeze blockages and exhaust natural gas to the atmosphere.

The present invention overcomes the deficiencies of the prior art by providing a system for injecting a chemical from a chemical supply, such an odorant for natural gas, into a fluid containing system, such as a natural gas pipeline. Rather than utilizing an injection pump, the present system utilizes an odorant storage tank which, in the preferred form, is pressurized by a source of inert gas, thereby maintaining the tank pressure at a desired positive pressure above the pressure of the gas pipeline to be odorized. Alternatively, the storage tank can be located appropriately to allow gravity feed of the odorant with a pressure "head" being used to move the odorant from the tank through an injection conduit to the natural gas pipeline. An extremely accurate metering means is provided within the injection conduit which communicates odorant from the odorant storage tank to the pipeline. The metering means is preferably a photooptic metering means which meters odorant on a drop wise basis with individual drops of the odorant being counted as they pass through the injection conduit into the pipeline being odorized.

The invention can best be understood with reference to FIG. 1 which illustrates the principal components of the system in simplified, schematic fashion. The system includes a chemical storage tank 11 which contains a chemical to be injected. In the preferred form of the invention, the tank 11 is used to store a suitable odorant for natural gas such as the tertiary butyl mercaptan (TBM). The tank 11 is connected to an injection conduit 13 by means of commercially available quick-disconnect fitting 15. The fitting 15 provides a portable tank 11 and allows the complete storage tank to be replaced as chemical within the tank is depleted.

The odorant contained within the tank 11 must be at a positive pressure which exceeds the pressure of the natural gas pipeline 17 into which the odorant is to be injected. In the preferred system, a pressurized gas source 18 communicates with the chemical's storage tank 11 by means of conduit 19 and regulator valve 21 for maintaining the tank 11 at a desired positive pressure above the pressure of the natural gas pipeline 17. For example, if the pipeline 17 is maintained in the range of 300 to 400 psi, the storage tank 11 can be maintained in the range of 500 psi by means of nitrogen blanket provided by the nitrogen tank 17. An isolation valve 22 can also be present in the conduit 19. In the embodiment of the invention illustrated in FIG. 1, the storage tank 11 is also equipped with a level float 24 and a sensor unit 26.

While the preferred form of the invention utilizes a pressurized storage tank 11, it will be understood that gravity feed could also be utilized, if desired. In this configuration, the odorant vessel 11 would be mounted above the injection point. The top of the tank could be connected to the pipeline 17 to provide a pressure source while the bottom of the tank would be in communication with the injection conduit 13.

Figure 2:
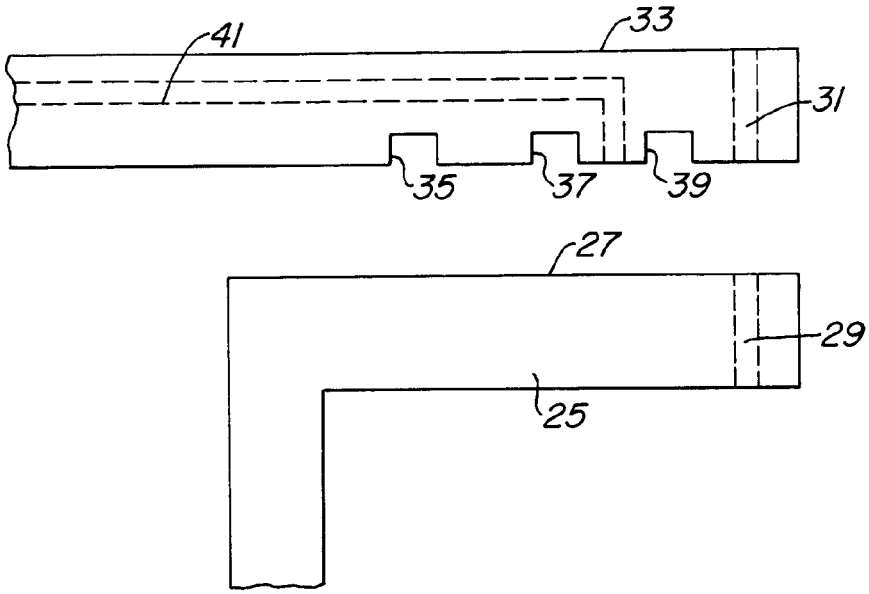
FIG. 2 is a partial, cross sectional view of the flange of the odorant vessel used in the method of the invention, showing the sealing features thereof.
Figure 3:
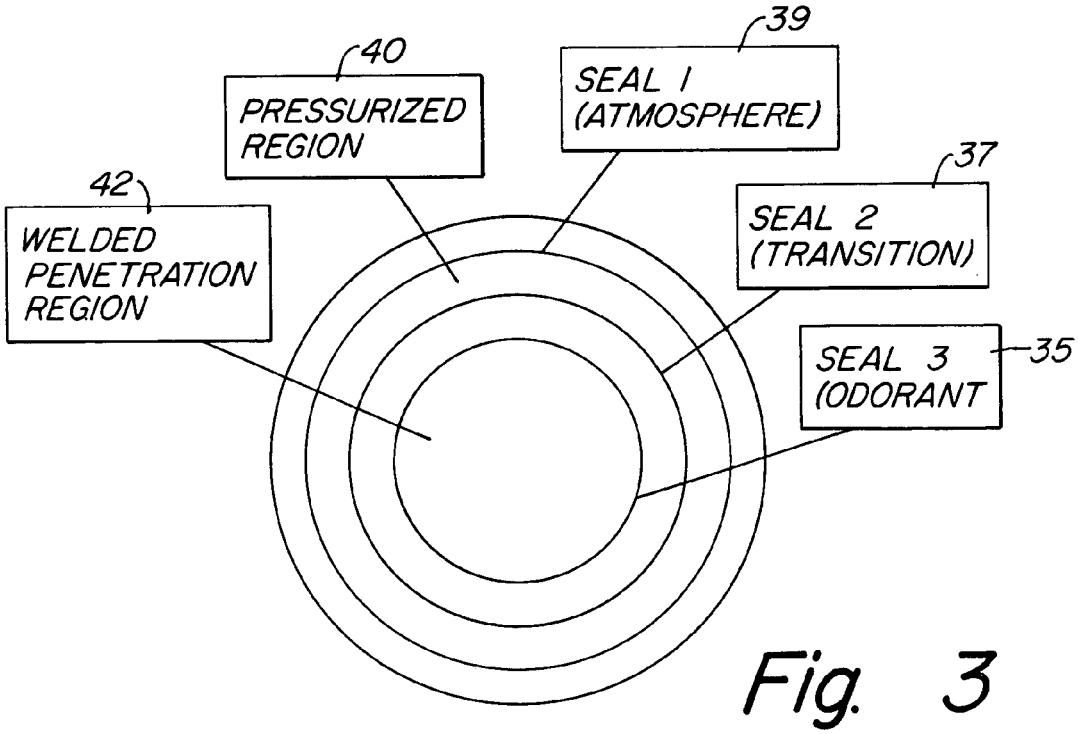
FIG. 3 is a simplified, schematic view of the sealing ring configuration of the storage tank of the invention.

One problem with pressurized odorization systems has been maintaining a proper seal on the odorant storage tank 11. When penetrations are made into the odorant vessel, a leak potential is always present. Pipe threads, gaskets and standard flanges have all been sources of leaks in the past. Additionally, O-ring materials that were optimized for one fluid were often adversely affected by other fluids present in the system. The development of micro channels in the seals caused a tested vessel to smell like natural gas. FIGS. 2 and 3 illustrate an improved vessel sealing arrangement for the system of the invention. The storage tank flange 25 has an upper planar sealing surface 27. A bore 29 mates with a corresponding bore 31 in the sealing lid 33 of the system. The sealing lid 33 has three O-rings circumferential grooves 35, 37, 39 for receiving O-ring seals. A channel 41 communicates nitrogen from the storage tank to the circumferential region between the outer grooves 37, 39. FIG. 3 also illustrates the sealing arrangement of the O-ring seals. As will be apparent from FIGS. 2 and 3, the O-ring 39 is at atmospheric pressure with seal ring 37 being a transition seal exposed to the pressurized region 40 and seal 35 being exposed to the odorant within the tank. All other penetrations are welded and located in the central portion 42 of the lid 33. In this way, the outer sealing ring 39 can be made of a material which is optimized for atmospheric conditions. The inner seal ring 35 can be optimized for contact with the particular odorant or chemical being injected.

The central seal 37 is a transition seal. Between the sealing rings 35 and 37 is a pressure chamber which keeps seals 35 and 37 loaded. This prevents O-ring movement caused by varying load pressures. Such movements have often, in the past, been a source of small odorant emissions escape.

Returning to the schematic illustration of the method shown in FIG. 1, odorant passes from the storage tank 11 through the odorant isolation valve 43 toward the pipeline 17. A metering means, designated generally as 45 is located within the injection conduit 13 for metering odorant to be injected into the pipeline. Preferably, as will be described, the odorant is metered on a drop wise basis with individual drops of odorant being counted as they pass through the injection conduit 13 into the pipeline 17.

As shown in FIG. 1, odorant flows through the injection conduit 13 to the odorant regulator valve 47 which drops the odorant pressure to a desired pressure slightly above the pipeline pressure. Preferably, the odorant regulator valve 47 adjusts the odorant pressure to only a few pounds, i.e., one or two pounds, or less above pipeline pressure. Alternatively, the odorant regulator valve 47 can be backed-off when the gravity feed arrangement, rather than the pressurized nitrogen gas arrangement, is utilized.

The flow control valve 49 controls the odorant flow rate. If high flow rates are anticipated, a flow meter 51 measures the odorant flow as the drops begin to turn into a stream. The flow control valve 49 continues to control odorant flow during this period. If the flow rate falls below a preset minimum of control valve 49, a timing mechanism closes and reopens to compensate. Drop size can be verified using the optional level monitor 24 located within the storage tank 11 or by the meter 51. Other empirical data, either current or historical, can also be utilized. A controller calculates drop size based on temperature, pressures, physical constants of the odorant blend and orifice size. The drop size can be verified and adjusted. The lowered pressure at the regulator valve 47 is matched to the CV of the flow control valve 49, providing the maximum control at valve 49.

The preferred metering means of the invention utilizes a flow control valve 49 which is capable of metering extremely precise amounts of odorant. The metering means also includes a drop counter, designated generally as 57, which is preferably selected from the group consisting of photooptic counters, laser counters and IR counters for counting drops of odorant which pass through the needle valve 49. In the most preferred system of the invention, the drop counter is a photooptic device in which an LED bundle 59 serves as light source, the light source being received by a pair of photo sensors 61, 63. The drop counter thus measures changing light intensity of a detecting beam which is interrupted by drops of chemical being injecting into the system. The flow control valve 49 and counting system provide extremely precise flow of odorant into the pipeline.

A particularly preferred flow control valve 49 is a servo driven needle valve for metering individual drops of odorant. The servo controlled needle valve 49 is an ultra fine valve which, in one preferred form, is a 1½ degree taper, eight turn needle valve with the needle orifice being on the order of 0.032 inches. A commercially available, servo driven, needle valve is available from ATI Systems, Inc. This servo controller valve is provided with circuitry which utilizes pulse width modulation in order to continually adjust the valve's position. A feed back circuit is utilized in order to verify the proper position of the needle valve with respect to its orifice. The needle is used to control the size of the flow orifice in order to obtain the smallest amount of odorant that can be dispensed and also measured as it is injected into the pipeline. Unlike the prior art pulses provided by solenoid valves, the present system accounts for every drop of odorant. When the flow rate increases to a stream, there are no gaps of odorization in the present system. The system of the invention offers advantages over both pulse and pump systems.

It will be understood that, while the invention is described with respect to the preferred servo controlled needle valve and optical drop counter, that other flow control valves and drop counters may be utilized, as well.

A controller, operative under the control of a program stored therein, is provided to precisely adjust the servo driven needle valve used for metering individual drops of chemical. The controller has inputs connected to a flow meter 64 of the type commonly present in the pipeline. A temperature sensor (not shown) is located in the odorant stream. As will be familiar to those skilled in the art, flow meter 64 generates a signal proportional to the flow of gas within the pipeline 17. The flow meter 64 can provide a digital pulse, or an analog signal, each time a known quantity of gas flows through pipeline 17.

An operator or supervisor inputs parameters for the particular system under consideration that permit flow and mass calculations to be accomplished. For example, these inputs can include those shown in Menu #3 which follows. Alarm functions can also be defined within the controller, as shown in Menu #2 which follows. In the preferred system, the processor measures the amount of time the photo sensors 61, 63 are interrupted by droplets. This time can be correlated to the vertical size of each droplet. When compared to the input parameters and/or historical data and combined with the dynamics unique to each odorant blend, this information provides relative droplet mass. Another method is to measure the relative drop in voltage. The mass calculation permits the invention to (1) provide another method of verification of the amount of odorant being dispensed into the pipeline; or (2) operate without the feedback from the level monitor 24 or with a feedback of smaller resolution.

FIG. 2 is a flow chart of the controller operation. The operator enters the various inputs to be described in step 66. The controller reads the inputs and I/O conditions in a step 68. As will be described with respect to the menus which follow, this can generate one or more alarms 70. In the next step 72, the controller calculates the odorant rejection time. In step 74, the servo of the needle valve 49 is instructed to adjust the needle orifice to achieve the desired drop time.

Figure 4:
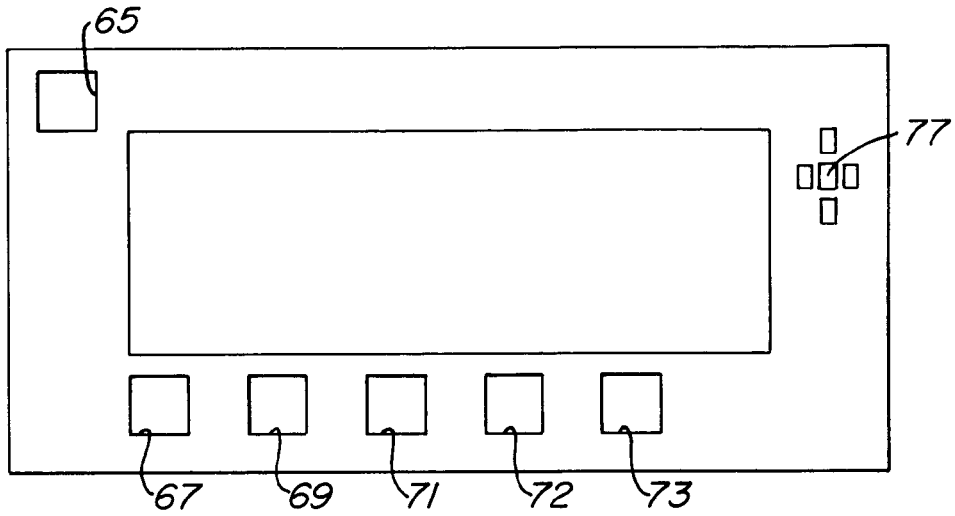
FIG. 4 is a view of the display screen of the controller used in the system of the invention.
Figure 5:
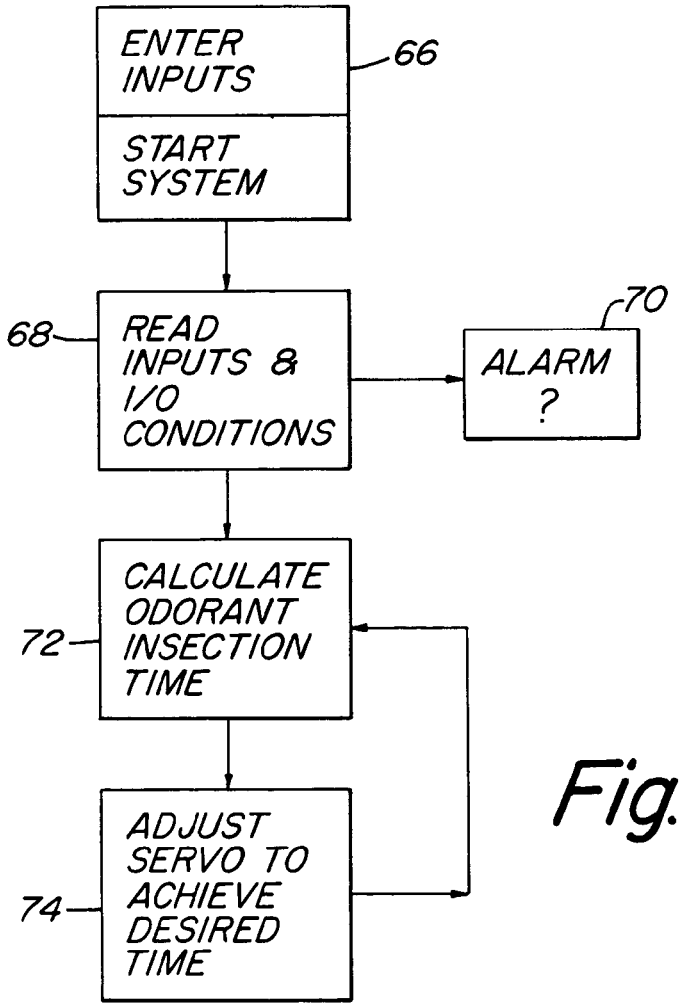
FIG. 5 is a flow chart of the operation of the controller used in the system of the invention.

FIG. 4 shows the controller display used in the preferred system. An on/off switch 65 enables the system to odorize. A main switch 67 flashes green as a drop flashes through the needle valve 49. An alarm switch 69 takes the user to the following menu # 2. The input switch 71 takes the user to the input parameter menu # 3 which follows. I/O switch 73 allows the user to access the I/O conditions found in menu #4. Finally, history switch 75 takes the user to the history menu # 5 which follows. Data can be entered by means of the keypad or toggle 77.

Menus:

1. Primary Window

| | Time |
|---|---|
| 1/08 #/Mmscf | Current Injection Rate |

2. Alarms

| | | |
|---|---|---|
| 1 | Injection Rate | Low/High |
| 2 | Flow Signal | Lost |
| 3 | Storage Level | Low |
| 4 | PhotoOptics | Sensor Down/LED Down |

3. Input Parameters

| | | | |
|---|---|---|---|
| 1 | Injection Rate | 1 .00#/MMscf | Drop Only/Full Range |
| 2 | Max. Gas Flow/ Assumed Gas Flow | 3.05 MMschfh | 20 mA/50 pps/fixed |
| 3 | Max Injection Rate | 2.00#/MMscf | |
| 4 | Odorant Blend | ChevPhillips/NGO/ AtoFina | BP Capatin 20/. . . |
| 5 | Orifice | A/B/C/. . . | |
| 6 | Options | Level/None | |
| 7 | Date/Time | Oct. 22, 2002 | 14:01 CST |
| 8 | Contract Time | 07:00 | |

4. I/O Conditions

| | | | |
|---|---|---|---|
| 1 | Remote | Enabled/disabled | Input |
| 2 | Gas Flow | 1.55 MMscfh | Input |
| 3 | Odorant Temperature | 30 F. | System Input |
| 4 | Level | 40% | System Input |
| 5 | Servo Position | 20.35% | System Input |
| 6 | Servo Position | 19.69% | System Output |
| 7 | Alarm | Active/None | Output |
| 8 | Injection Rate | 1.08 #/Mmscf | OUtput |

5. History

| | | |
|---|---|---|
| 1 | Today | 0.01 lbs |
| 2 | Yesterday | 0.43 lbs |
| 3 | Oct. to Date | 5.83 lbs |
| 4 | September | 11.54 lbs |
| 5 | August | 10.73 lbs |

An invention has been provided with several advantages. The odorization system of the invention is extremely simple as compared to existing positive displacement pump systems. The system offers improved ease of understanding, operation and maintenance. As compared to the prior art systems, the present system offers more accurate control, verification (drop counting) and communication (alarms, status, etc) than the prior art systems. The drop mode of injection offers extremely small volumes which are injected frequently for more even odorization. The continuous flow nature of the drop feed completely eliminates dead spots in the system. The two streams of fluid (natural gas and odorant) are blended evenly and proportionately. Compared to the prior art systems, the system of the invention offers a smell free operation and maintenance. No gas is exhausted to the atmosphere. In some states, the required odorization level is greater than in others. This means that odorized natural gas is being odorized to a greater level as it crosses state lines. The preodorized actuation gas is required to be scrubbed to prevent to leak calls during normal operation. When the scrubbers become saturated, the exhaust gas is detectable. The present invention eliminates these problems associated with the prior art. Additionally, the improved vessel flange system allows O-ring seals to be optimized to prevent leakage. The positive pressurization between the O-ring seals eliminates any leakage possibility.

While the invention has been shown in only one of its forms, it is not thus limited but is susceptible to various changes and modifications without departing from the spirit thereof.

What is claimed is:

1. A method of odorizing natural gas flowing through a pipeline by injecting odorant into the pipeline at a controlled rate, the method comprising the steps of:

providing an odorant storage tank containing an odorant to be injected;

communicating a pressurized source of inert gas with the odorant storage tank for maintaining the tank at a desired positive pressure above the pressure of the pipeline;

providing an injection conduit communicating the odorant storage tank with the pipeline;

providing metering means located within the injection conduit for metering odorant to be injected into the pipeline on a dropwise basis with the individual drops of odorant being counted as they pass through the metering means into the injection conduit and into the natural gas pipeline;

wherein the metering means includes a servo driven flow control valve which controls the flow of odorant through an orifice; and wherein the metering means includes counting means for counting individual drops of odorant passing through the orifice into the injection conduit, the counting means including a photooptic light source and mating sensor.

2. The method of claim 1, wherein the counting means measures changing light intensity of a detecting beam emitted by LED's in the photooptic light source which is interrupted by the drops of chemical being injected into the system.

3. A method of odorizing natural gas flowing through a pipeline by injecting odorant into the pipeline at a controlled rate, the method comprising the steps of:

providing an odorant storage tank containing an odorant to be injected, the odorant tank being maintained at a desired positive pressure above the pressure of the pipeline;

providing an injection conduit communicating the odorant storage tank with the pipeline;

providing a servo driven flow control valve which controls the flow of odorant through an orifice, the servo driven flow control valve being located within the injection conduit for metering odorant to be injected into the pipeline on a dropwise basis; and providing a counter for counting individual drops of odorant which flow through the servo driven flow control valve into the injection conduit, the counter being selected from the group consisting of photooptic counters, laser counters and I.R. counters for counting drops of odorant which pass through the flow control valve.

4. The method of claim 3, wherein a pressurized gas source communicates with the odorant storage tank for maintaining the tank at a desired positive pressure above the pressure of the natural gas pipeline and thereby pressurizes the odorant tank.

5. The method of claim 3, wherein the odorant storage tank is positioned relative to the natural gas pipeline to allow gravity feed of the odorant to be injected into the natural gas pipeline.

* * * * *